US007651012B2

(12) United States Patent
Colman et al.

(10) Patent No.: US 7,651,012 B2
(45) Date of Patent: Jan. 26, 2010

(54) TOOTHPASTE DISPENSER, TOOTHPASTE DISPENSING SYSTEM AND KIT

(75) Inventors: Arne Benjamin Colman, Newark (GB); Lee Burrowes, Woking (GB); Sarah Louise Thielman, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 776 days.

(21) Appl. No.: 11/240,284

(22) Filed: Sep. 30, 2005

(65) Prior Publication Data

US 2007/0075100 A1 Apr. 5, 2007

(51) Int. Cl.
*B67D 5/40* (2006.01)

(52) U.S. Cl. ..... 222/372; 222/105; 222/181.3; 222/182; 222/183; 222/325; 222/326; 222/380; 222/386

(58) Field of Classification Search ..... 222/94–95, 222/105, 325, 327, 383.1, 182, 372, 380, 222/181.3, 494, 183, 326, 386
See application file for complete search history.

(56) References Cited

U.S. PATENT DOCUMENTS

| | | | | | |
|---|---|---|---|---|---|
| 1,869,685 | A | * | 8/1932 | Gusdorf | 222/96 |
| 2,090,733 | A | * | 8/1937 | Piquerez | 222/95 |
| 3,211,340 | A | * | 10/1965 | Zander et al. | 222/95 |
| 3,885,707 | A | | 5/1975 | Wittwer | |
| 4,019,655 | A | | 4/1977 | Moeller | |
| 4,508,239 | A | * | 4/1985 | Rozzen | 222/39 |
| 4,570,829 | A | * | 2/1986 | Allen | 222/207 |
| 5,209,376 | A | | 5/1993 | Dirksing | |
| 5,234,688 | A | | 8/1993 | Gaffar | |
| 5,260,062 | A | | 11/1993 | Gaffar | |
| 5,305,922 | A | | 4/1994 | Varon | |
| 5,400,839 | A | | 3/1995 | Cravett | |
| 5,501,340 | A | | 3/1996 | Stafford | |
| 5,626,260 | A | | 5/1997 | Waldner | |
| 5,810,205 | A | | 9/1998 | Kohen | |
| 5,845,813 | A | | 12/1998 | Werner | |
| 5,897,030 | A | | 4/1999 | Stangle | |
| 6,016,853 | A | | 1/2000 | Wang | |
| 6,083,000 | A | | 7/2000 | Charlton | |
| 6,095,814 | A | | 8/2000 | Petrich et al. | |
| 6,325,076 | B1 | | 12/2001 | Ramirez | |

(Continued)

FOREIGN PATENT DOCUMENTS

EP 0 457 452 A2 11/1991

OTHER PUBLICATIONS

PCT Search Report, mailed Feb. 16, 2007, 4 pages.

*Primary Examiner*—Frederick C. Nicolas
(74) *Attorney, Agent, or Firm*—Ken K. Patel; Laura L. Whitmer; George H. Leal

(57) ABSTRACT

A toothpaste dispensing system includes a low-profile toothpaste dispenser with a housing, a pumping system disposed in the housing, the pumping system having a inlet and an outlet, the pumping system having a rest state and an active state, the pumping system ejecting toothpaste as it transitions from the rest state to the active state, and a low-force activator coupled to the pumping system to transition the pumping system from the rest state to active state. The system also includes a toothpaste refill coupled to the inlet of the pump. The dispenser and refill may be all or part of a dental hygiene kit.

12 Claims, 8 Drawing Sheets

U.S. PATENT DOCUMENTS

| | | | | |
|---|---|---|---|---|
| 6,345,731 | B2 | 2/2002 | Bitton | |
| 6,347,728 | B1 | 2/2002 | Apolloni et al. | |
| 6,454,133 | B1 | 9/2002 | Lopez et al. | |
| 6,474,506 | B2 | 11/2002 | Mawby et al. | |
| 6,474,509 | B1 | 11/2002 | Prince et al. | |
| 6,509,007 | B2 | 1/2003 | Rajaiah et al. | |
| 6,659,309 | B2 | 12/2003 | Friedman | |
| 6,675,845 | B2 | 1/2004 | Volpenheim et al. | |
| 6,685,013 | B2 | 2/2004 | Discko, Jr. | |
| 6,685,375 | B1 | 2/2004 | Crocker | |
| 6,715,521 | B2 | 4/2004 | Back | |
| 6,729,501 | B2 | 5/2004 | Peterson | |
| 6,789,703 | B2 | 9/2004 | Pierre-Louis | |
| 6,834,780 | B2 | 12/2004 | Levy | |
| 6,896,153 | B1 * | 5/2005 | Yencheng | 222/78 |

* cited by examiner

TOOTHPASTE DISPENSER, TOOTHPASTE DISPENSING SYSTEM AND KIT

FIELD OF THE DISCLOSURE

The present disclosure generally relates to a toothpaste dispenser, and in particular to a toothpaste dispenser and toothpaste refill that may be combined as a toothpaste dispensing system or as part or all of a dental hygiene kit.

BACKGROUND OF THE DISCLOSURE

The teaching and motivation of toddlers and young children is a subject of much attention in patent and general literature. In particular, numerous writings, devices, techniques, aides, and kits have been proposed to assist the children, the parent (or other caregiver), or both, with learning and performing oral hygiene tasks. A common challenge for a caregiver is to teach the child to perform a complete oral hygiene task, particularly where the task requires several steps. At the outset, a caregiver will often provide at least some assistance and instruction on how to complete the task. The ultimate goal, however, is for the child to be able to execute the oral hygiene task unassisted. The age at which a child will practice an oral hygiene task on his or her own is dependent upon many factors, some of which are psychological, some physiological, and some unique to each individual child.

Conventional oral hygiene products and methods are overly difficult for a child to use or perform. When performing tooth brushing, for example, current products typically require a child to simultaneous manipulate two separate items at some point in the process. When loading a brush with toothpaste, for example, the child must hold the toothbrush in one hand while dispensing toothpaste from a container with the other hand. Unfortunately, many children are unable to properly or efficiently perform this task, since they are at a state of physiological development where muscle control and general coordination are limited. Consequently, oral hygiene apparatus and methods are needed that facilitate successful use by children.

SUMMARY

In one aspect, a toothpaste dispenser includes a low-profile housing having a base disposable on a surface, the base having a width and a length that is greater than its width and the low-profile housing having a height that is comparable to the width of the base. The dispenser also includes a pumping system disposed in the housing, having a inlet couplable to a toothpaste refill and an outlet and having a rest state and an active state, the pumping system ejecting toothpaste as it transitions from the rest state to the active state. The dispenser further includes a low-force activator coupled to the pumping system to transition the pumping system from the rest state to the active state.

In another aspect, a toothpaste dispensing system includes a dispenser with a low-profile housing, a pumping system disposed in the housing, the pumping system having a inlet and an outlet, the pumping system having a rest state and an active state, the pumping system ejecting toothpaste as it transitions from the rest state to the active state, a low-force activator coupled to the pumping system to transition the pumping system from the rest state to the active state, and a carrier disposed within the housing, the carrier having a holder and moveable between a loading position, wherein the holder is spaced from the inlet of the pumping system, and an operative position, wherein the holder is adjacent the inlet of the pumping system. The system also includes a toothpaste refill disposed on the carrier and coupled to the inlet of the pumping system.

In a further aspect, a toothpaste refill is provided for use with a toothpaste dispenser including a housing, a pumping system having an inlet, and a carrier moveable between a loading position, wherein the holder is spaced from the inlet of the pumping system, and an operative position, wherein the holder is adjacent the inlet of the pumping system, the carrier having a holder. The refill includes a wall that defines a pouch, a guide attached to the wall and having a passage therethrough, the guide being adapted to mate with the holder to limit movement of the refill relative to the carrier, a valve disposed within the pouch and in communication with the passage in the guide and a volume of toothpaste disposed in the pouch.

Additional aspects of the disclosure are defined by the claims of this patent.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale.

DETAILED DESCRIPTION

FIGS. 1-11 illustrate an embodiment of a toothpaste dispenser 40, while FIGS. 12-16 illustrate an embodiment of a toothpaste refill 42 that may be used with the toothpaste dispenser 40. It will be recognized that the toothpaste dispenser 40 may be used with toothpaste refills other than that shown in FIGS. 12-16, and that the toothpaste refill 42 may be used with toothpaste dispensers other than that shown in FIGS. 1-11. However, the dispenser 40 and the refill 42 may be advantageously used together as a toothpaste dispensing system, and may form, in whole or in part, a dental hygiene kit (in combination, for example, with a toothbrush).

Further, the Figures illustrate that the dispenser 40 and the refill 42 each have many different aspects, or features, several of which are explained in greater detail below. It will be recognized that while an embodiment of the dispenser 40 and the refill 42 are explained below with reference to these several aspects, it is not essential that each and every aspect so explained be present in each and every embodiment of the dispenser or refill according to this disclosure. Thus, another embodiment of the dispenser 40 or the refill 42 may include only certain aspects of the dispenser 40 and the refill 42 explained herein, and another embodiment may include still other aspects not explained herein.

Figure 1:
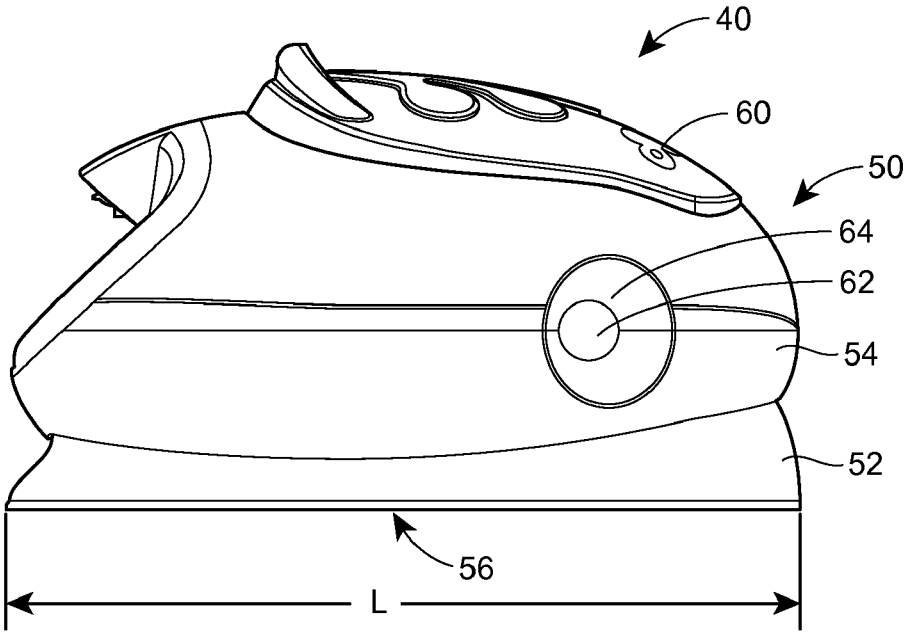
FIG. 1 is a side view of a toothpaste dispenser according to the present disclosure.
Figure 2:
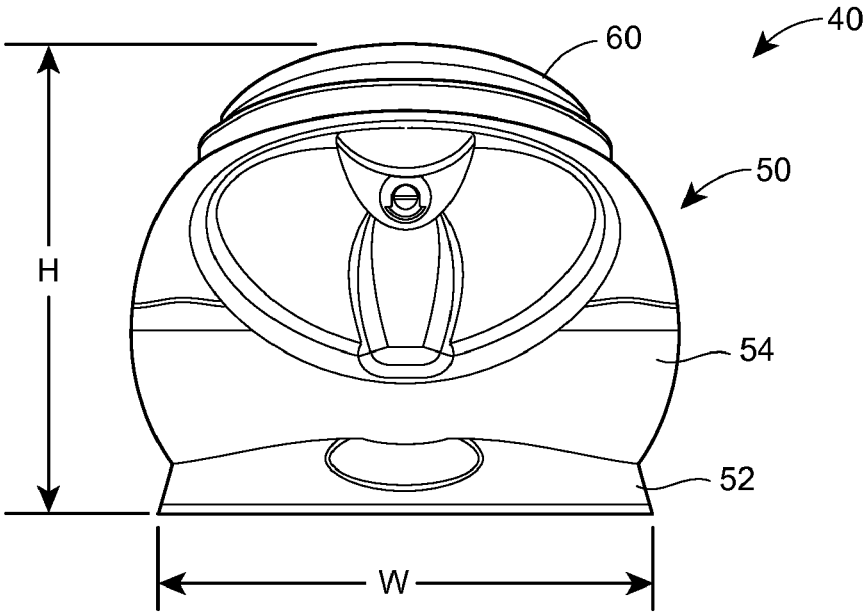
FIG. 2 is a frontal view of the toothpaste dispenser of FIG. 1.
Figure 3:
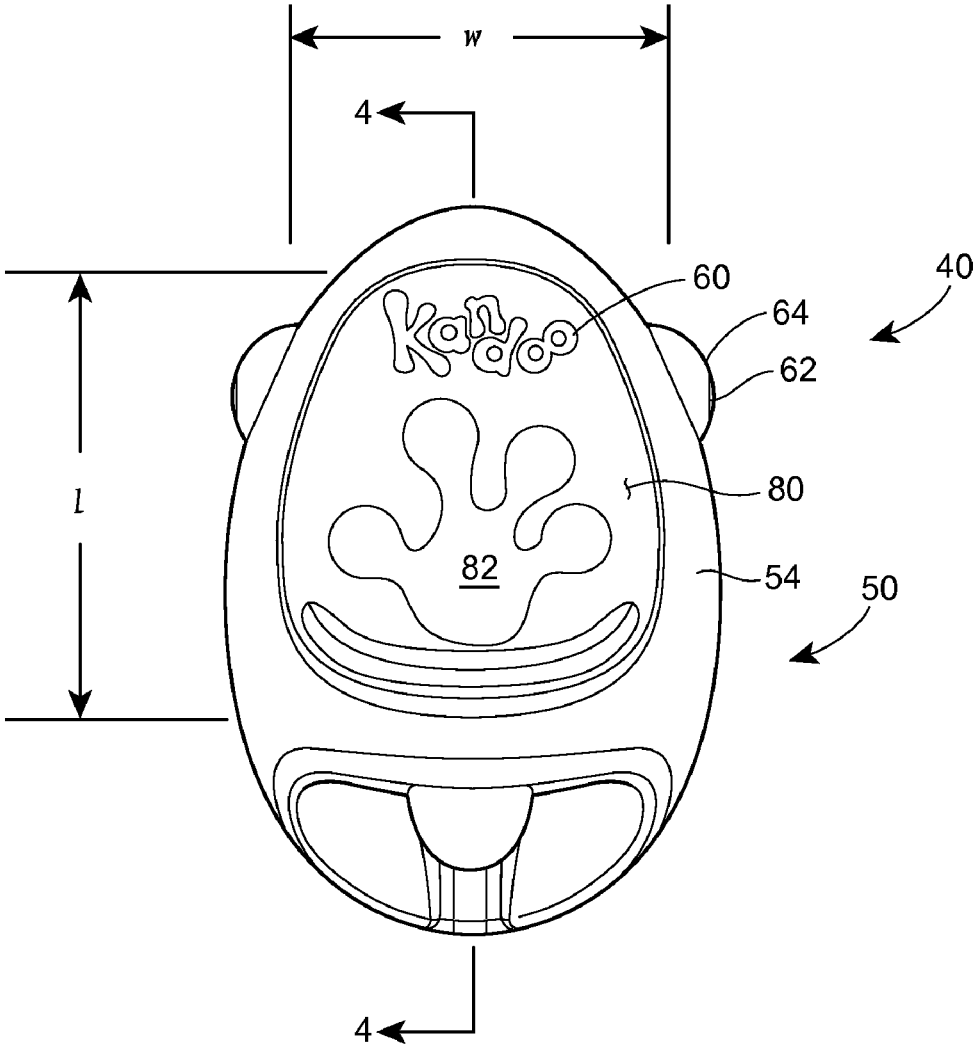
FIG. 3 is a plan view of the toothpaste dispenser of FIG. 1.
Figure 5:
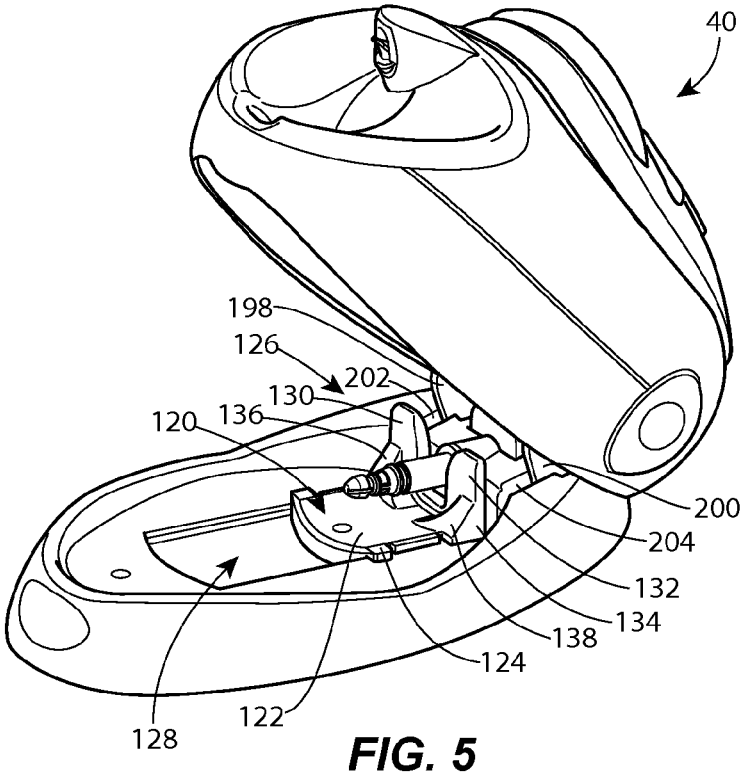
FIG. 5 is a perspective view of the toothpaste dispenser, with a carrier for the toothpaste refill in an operative position.
Figure 6:
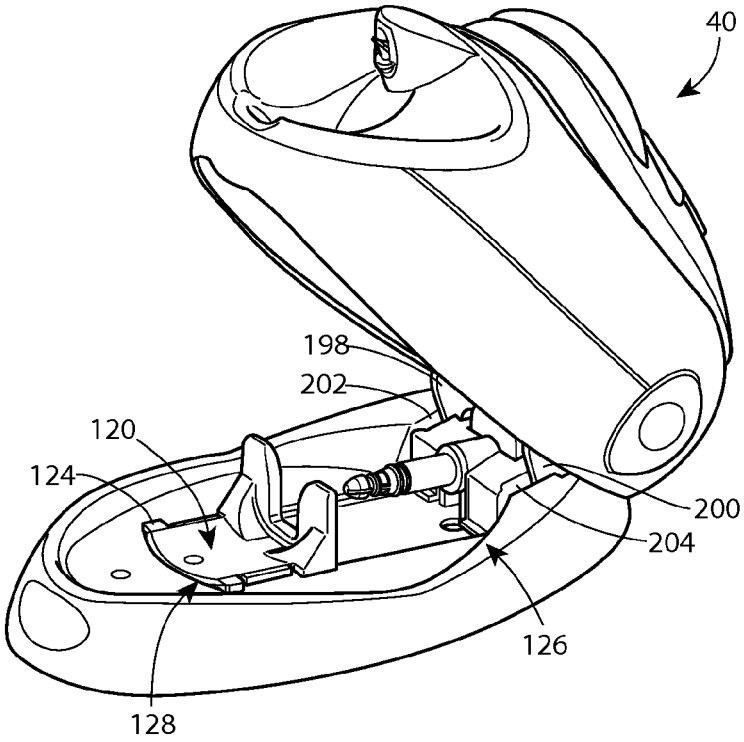
FIG. 6 is a perspective view of the toothpaste dispenser, with a carrier for the toothpaste refill in a loading position.
Figure 8:
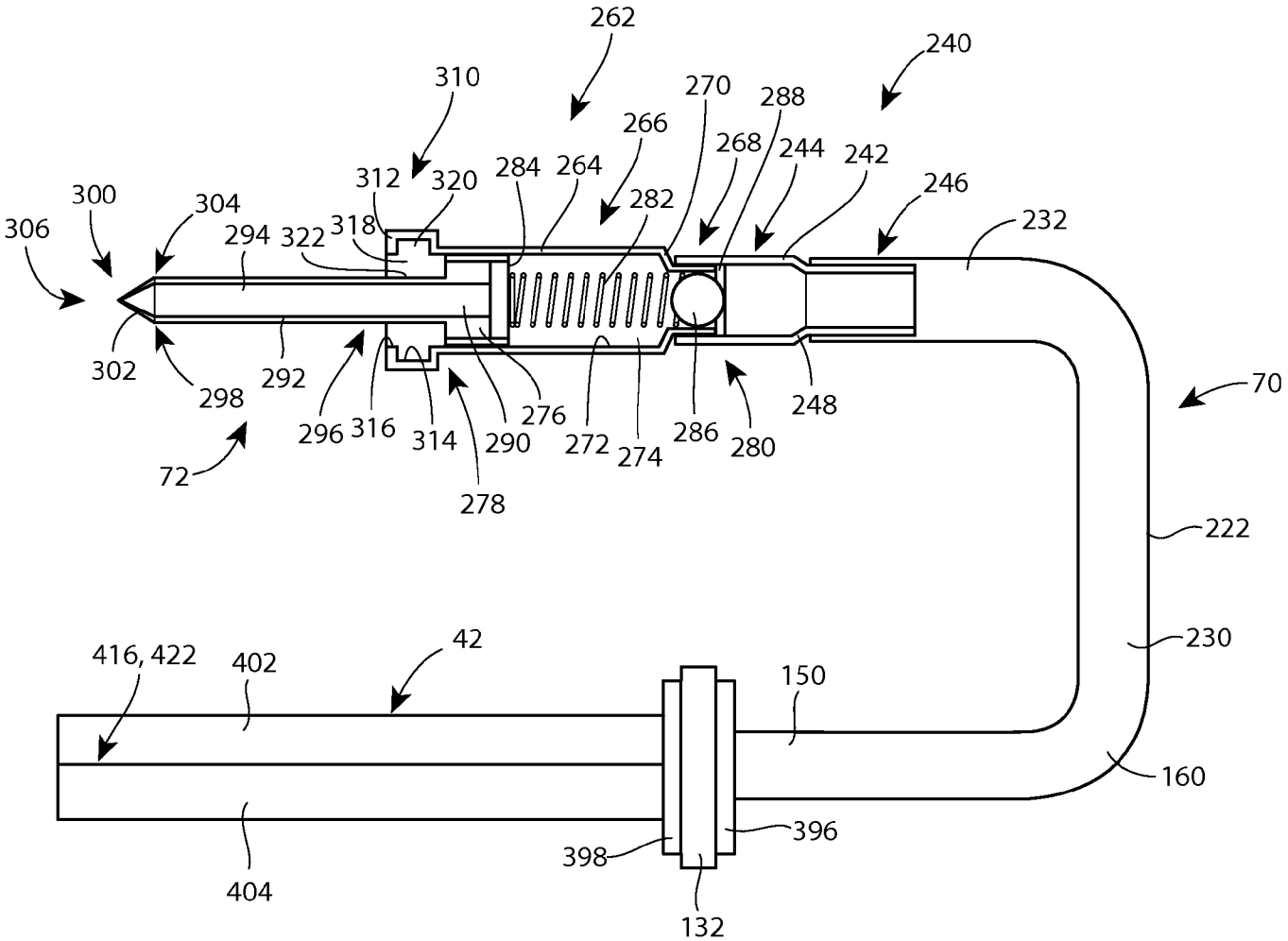
FIG. 8 is a cross-sectional view of the pumping system of the dispenser of FIG. 1.
Figure 9:
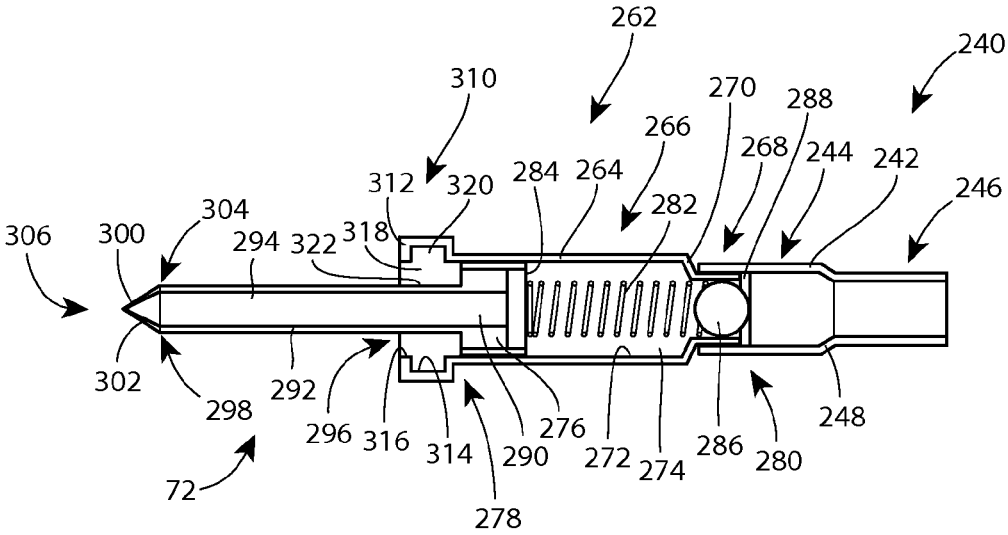
FIG. 9 is a fragmentary, cross-sectional view of the pumping system of FIG. 5, with the pump in the rest state.
Figure 10:
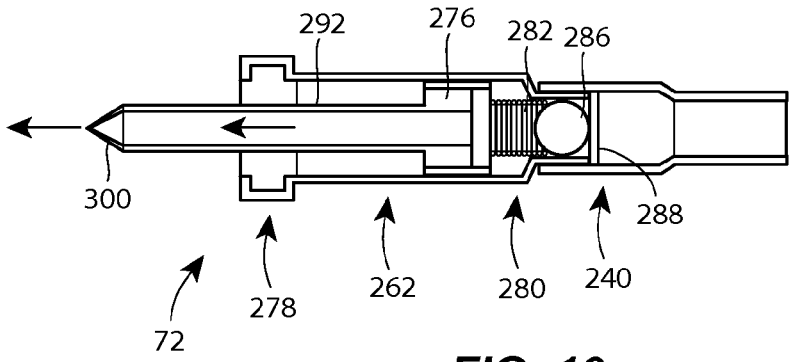
FIG. 10 is a fragmentary, cross-sectional view of the pumping system of FIG. 5, with the pump in an active state.
Figure 11:
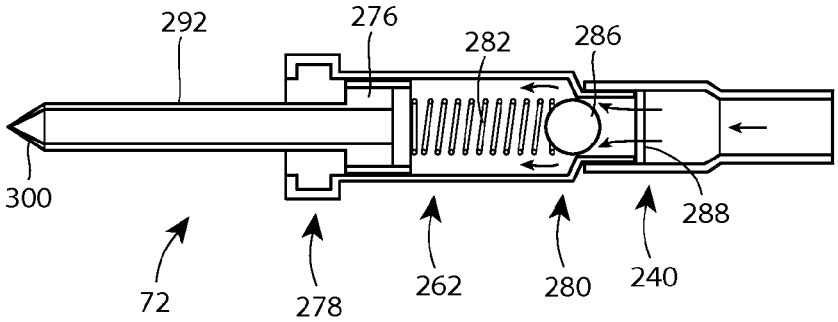
FIG. 11 is a fragmentary, cross-sectional view of the pumping system of FIG. 5, with the pump transitioning from the active state to the rest state.

Turning first to FIGS. 1-3, the toothpaste dispenser 40 includes a housing 50. The housing 50, in turn, includes a base 52 and a cover 54. The base 52 may have a surface 56, which as illustrated is substantially planar, for disposing the dispenser 40 on a surface, such as a countertop, although, according to alternative embodiments, the dispenser 40 may be mounted on a wall with the surface 56 disposed on the wall surface. Also, according to certain embodiments, a non-slip material, such as a thermoplastic elastomer (TPE), for example, may be disposed on the surface 56. The base 52 may be pivotally connected to the cover 54 so that the cover 54 may move between a closed position, as shown in FIGS. 1-3, for example, and an open position, as shown in FIGS. 5 and 6. Additionally, a spring (not shown) may be included to bias the cover 54 towards the closed position.

The dispenser 40 may be a low-profile dispenser. That is, the base 52 of the dispenser 40 has a width "W" (as seen in FIG. 2) and a length "L" (as seen in FIG. 1) that is greater than its width "W". Moreover the housing 50 may have a height "H" (as seen in FIG. 2) that is comparable to the width "W". It is believed that the large footprint (W by L) of the base 52 relative to the height H of the housing 50 limits the tendency of the housing 50 to tip over. The dimensions of the width W, length L, and height H may be in a ratio of approximately 1:2:1, or more preferably 3:5:3.

The dispenser 40 also may have a center of mass that is closer to the surface 56 than a center of volume. That is, while the center of the volume may lie approximately at the midpoints of the width W, length L and height H, the width and length of the housing 50 being approximately the same as the width and the length of the base 52, the distance of the center of mass from the surface 56 may be less than half the height H. This may be true whether the toothpaste refill 42 is full or substantially empty. It is believed that the fact that the center of mass is closer to the surface 56 than the center of volume may also limit the tendency of the dispenser 40 to tip when forces are applied to the housing 50 during use.

The dispenser 40 may also include an activator 60, as best seen in FIG. 3. The activator 60 may be pivotally connected to the cover 54, for example, through the cooperation of lugs 62 that extend from the activator 60 and are received in apertures 64 formed in the cover 54. The activator 60 is coupled to a pumping system 70, as may be seen in FIG. 8, such that the movement of the activator 60 between a first position (FIG. 4) and a second position (FIG. 7) causes the pumping system 70 (or more particularly, a pump 72) to move between a rest state (FIG. 4) and an active state (FIG. 7), the pumping system 70 ejecting material from the dispenser 40 as it transitions from the rest state to the active state.

The activator 60 may have an activation surface 80 with a width "w" and a length "l" (see FIG. 3) that are comparable to the width W and the length L of the base 52 and housing 50. As illustrated, the width w is substantially similar to the width W, while the length l is nearly ¾ of the length L. It is believe that the large area of the activation surface 80 will facilitate manipulation of the activator 60 by younger users, whose motor skills may be not fully developed yet. Moreover, it is believed that the activator 60 will require a low force to operate (for example, the force may be on the order of 10-30 Newtons). Further, a non-slip material, such as TPE, for example, may be disposed on the surface 80 to facilitate operation of the activator 60 by younger users.

One or more symbols 82 may be applied to the activation surface 80 of the activator 60. The one or more symbols 82 may be alphabetic characters that explain the method of use of the dispenser 40. However, the one or more symbols 82 may be graphics, icons, or other images that may be used to attract the attention of a younger user, and may even be used to instruct a younger user. For example, as illustrated, the symbol 82 may be of stylized or cartoon hand, such as of a frog, which may indicate to the younger user that he or she is to depress the activator 60 to use the dispenser 40.

Figure 4:
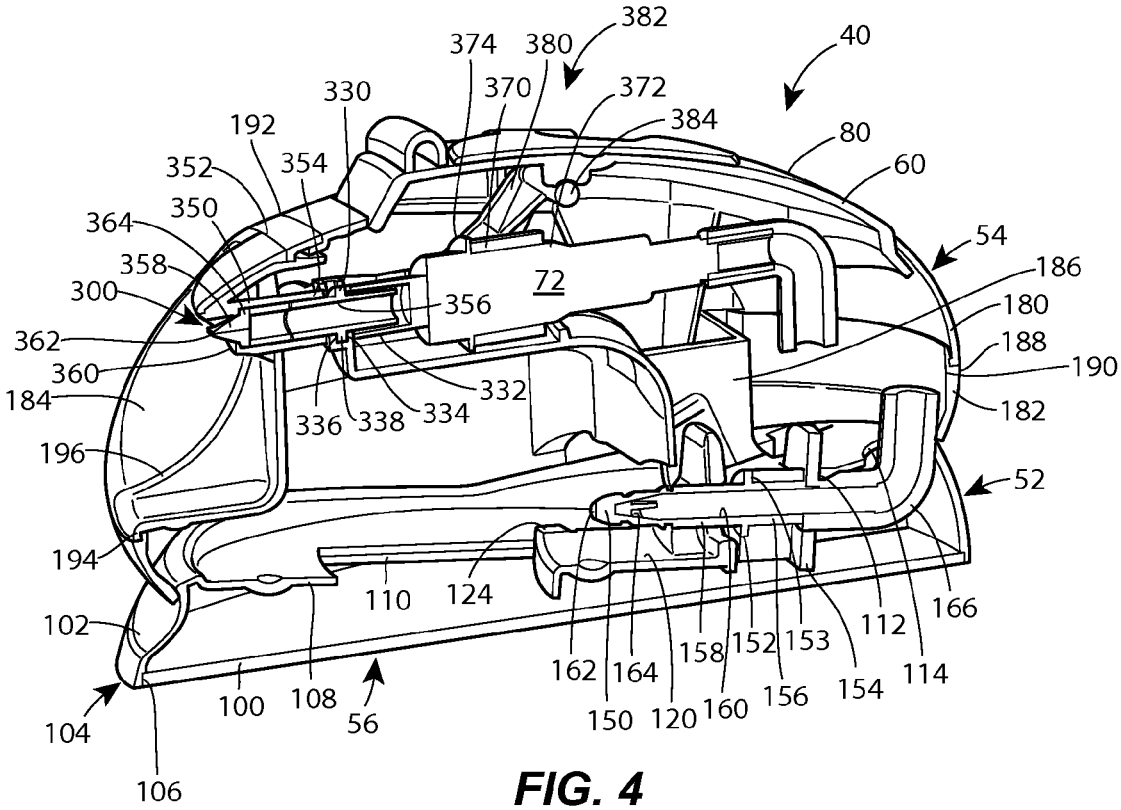
FIG. 4 is a cross-sectional, perspective view of the toothpaste dispenser of FIG. 3 taken about line 4-4, with the pump in a rest state.

Turning now to FIG. 4, the internal structure of the base 52 and the cover 54, as well as the pumping system 70, is discussed in greater detail.

As shown in FIG. 4, the base 52 may be made of a first, substantially planar plate 100 and a second, substantially concave plate 102. The second plate 102 may have a stepped rim 104, which may define a shoulder 106 against which the first plate 100 abuts when the first plate 100 is attached to the second plate 102. The second plate 102 may also have a surface 108 with openings 110, 112, 114 therethrough. As illustrated, the openings 110, 112 are in the form of substantially rectangular slots and the opening 114 is a substantially circular hole, although other shapes may also be used.

A carrier 120 is disposed in the opening 110. The carrier 120 may have a base 122 from which tabs 124 (only one of which is visible in FIG. 4) depend, the tabs 124 being disposed on opposite sides of the plate 102. The placement of the tabs 124 on opposite sides of the plate 102 limits the separation of the carrier 120 from the plate 102, and assists in guiding the carrier 120 along the slot 110 as it moves or translates from one end 126 of the slot 110 to the other end 128, as seen best in FIGS. 5 and 6. In operation, the toothpaste refill 42 is removably coupled to the carrier 120, and moves or translates with the carrier along the surface 108 of the plate 102 from one end 126 of the slot 110 to the other end 128. When the carrier 120 is located at the first end 126 (FIG. 5), this may be described as the operative position. When the carrier 120 is located at the second end 128 (FIG. 6), this may be described as the loading position.

The carrier 120 may also have first and second arms 130, 132 that depend upwardly away from the base 122. The arms 130, 132 may define a holder 134 that cooperates with a mating structure on the toothpaste refill 42, as will be explained in greater detail below, to limit the movement of the toothpaste refill 42 relative to the carrier 120. In particular, the arms 130, 132 and the base 122 may define a U-shaped structure with its bight defined by the base 122. The carrier 120 may also include reinforcements 136, 138 (one of which may be seen in FIG. 4, but both of which may be seen in FIGS. 5 and 6), which assist in strengthening the attachment between the arms 130, 132 and the base 122. As shown, the base 122, arms 130, 132, and reinforcements 136, 138 are integrally formed, although they may be formed as separate pieces that are attached together to make the entire assembly of the carrier 120.

Returning to FIG. 4, an inlet piece 150 is disposed in part through the slot 112 and the hole 114, and in part disposed between the first and second plates 100, 102. In particular, the inlet piece 150 includes a first flange 152 that abuts a shoulder 153 formed at the first end 126 of the slot 110, and a second flange 154, that is received within the slot 112. The flanges 152, 154 cooperate with the plate 102 to limit movement of the inlet piece in a first direction. The flange 154 also may abut the first plate 100 of the base 52, which may act to limit movement of the inlet piece 150 relative to the base 52 in at least a second direction.

The inlet piece 150 also includes a long hollow shaft 156, having an exterior surface 158, to which the flanges 152, 154 may be attached or with which the flanges 152, 154 may be formed, and an interior surface 160. The shaft 156 has a first, pointed end 162, in which several apertures or ports 164 are formed or defined, and a second end 166, that has the appearance of a substantially right-angle elbow joint.

As also shown in FIG. 4, the cover 54 may be assembled from several pieces, including a first shell piece 180, a second shell piece 182, a frontal piece 184 and an interior support structure 186. The first and second shell pieces 180, 182 may be thin-walled structures that when joined along mating edges 188, 190 give the cover 54 its external ovoid shape, when combined with the activator 60. It is believed that the ovoid shape of the cover 54 may facilitate manipulation of the dispenser 40 by younger users, and facilitate cleaning the outer surface of the dispenser 40 by a caregiver, such as a parent. The frontal piece 184 mates with the shell pieces 180, 182 along edges 192, 194 to complete the external surface of the cover 54. A material, such as TPE, for example, may be disposed along all of these joints between the pieces 180, 182, 184 to limit the migration of moisture into the dispenser 40. The frontal piece 184 may have a shoulder 196 formed therein, to be used to position a toothbrush (e.g., electric, manual, finger, etc.) relative to the dispenser 40 to facilitate proper brush placement (e.g., the head of the toothbrush relative to the element through which toothpaste is dispensed). The shoulder 196 may be particularly sized to accommodate a single type of toothbrush, or may be sized to accommodate a variety of toothbrushes. The interior support structure 186 may be joined to one or both of the shell pieces 180, 182, and may have first and second arms 198, 200 (see FIGS. 5 and 6) that are received in slots 202, 204 formed in the plate 102 of the base 52 (see also FIGS. 5 and 6) and cooperate with the base 52 to permit the cover to be pivotally connected to the base. The interior support structure 186 may also support and cooperate with the activator 60 in the operation of the pumping system 70.

Figure 7:
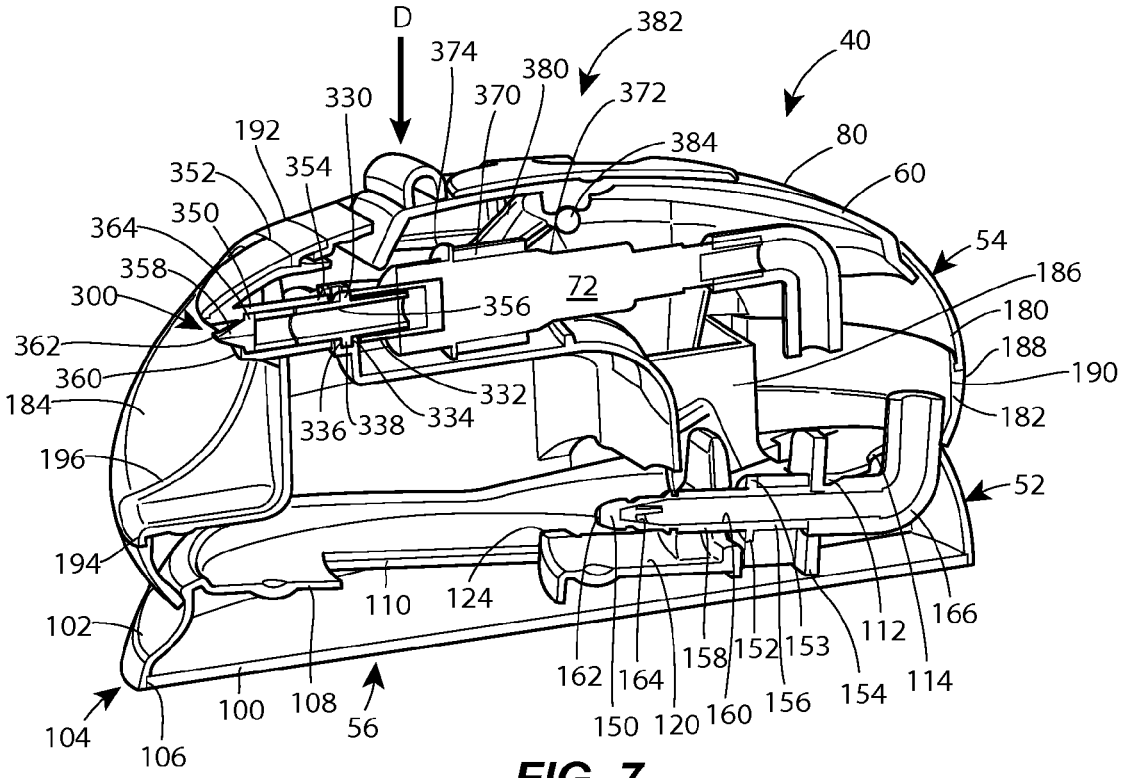
FIG. 7 is a cross-sectional, perspective view of the toothpaste dispenser of FIG. 3 taken about line 4-4, with the pump in the active state.

The pumping system 70 is shown as installed in FIGS. 4 and 7, but is also shown separately in part in FIGS. 8-11. The pumping system 70 is but one type of pumping system that may be used in or with the dispenser 40. The pumping system 70 includes the pump 72 and the inlet piece 150, as already explained. As further illustrated, the system 170 includes a connecting tube 220 (which tube 220 is shown broken in FIGS. 4 and 7 to permit better visibility of the internals of the dispenser 40, and shown in whole in FIG. 8). The structure of the pumping system 70 is now discussed in greater detail with reference to FIG. 8.

A first end 230 of the connecting tube 220 is connected to the elbow-like end 166 of the inlet piece 150. The second end 232 of the connecting tube 220 is connected to an inlet fitting 240 of the pump 72.

The inlet fitting 240 is hollow and substantially cylindrical in shape, with a single wall 242 defining the interior and exterior surfaces. The wall 242 has different diameters along its length, tapering from a first section 244 of a larger diameter to a second section 246 of a smaller diameter. The two sections 244, 246 meet at a stepped shoulder 248. The second end 232 of the connecting tube 220 fits over the second section 246 and may abut the shoulder 248 as assembled.

The first section 244 of the inlet fitting 240 receives a first end 260 of the main cylinder 262 of the pump 72. Similar to the inlet fitting, the main cylinder 262 of the pump 72 is hollow and substantially cylindrical in shape, with a single wall 264 defining interior and exterior surfaces. The wall 264 has different diameters along its length, tapering from a first section 266 of larger diameter to a second section 268 of a smaller diameter. The two sections 266, 268 meet at a stepped shoulder 270. The second section 268 of the main cylinder 262 is received in the first section 244 of the inlet fitting 240.

The interior surface 272 of the wall 264 defines a main pumping chamber 274. Disposed within the main pumping chamber 274 is a piston head 276. The piston head 276 moves within the main pumping chamber 274 between a first end 278 and a second end 280. The piston head 276 is biased towards the first end 278 by a spring 282 that is disposed between a face 284 of the piston head 276 and a ball 286 that is supported on a shoulder 288.

The piston head 276 has a passage 290 formed therethrough. The piston head 276 is attached to a hollow piston stem 292 with a passage 294 formed therethrough. The head 276 is attached to a first end 296 of the stem 292 so that the passage 290 aligns with the passage 294.

The second end 298 of the stem 292 is attached to a nozzle 300. The nozzle 300 may be formed from a piece of TPE (thermoplastic elastomer) that may be triangular in cross-section, but, more generally, the nozzle 300 may be formed from an elastic material. The nozzle 300 may have a slit 302 formed therethrough, from the base 304 to the apex 306. The base 304 of the nozzle 300 is connected to the stem 292 such that the passage 294 is aligned with the slit 302.

Attached to the first end 278 of the pumping chamber 274 is a sealing assembly 310. The sealing assembly 310 includes an annular ring 312 that is attached to the main cylinder 262. The annular ring 312 has a groove 314 formed in an interior surface 316 thereof. An annular seal 318 has an outer edge 320 that is disposed in the groove 314 to limit the movement of the seal 318 relative to the cylinder 262. The piston stem 292 passes through the central passage 322 of the seal 318.

In operation, it is intended for the piston head/piston stem assembly 276, 292 to move relative to the main cylinder 262 to cause the toothpaste to be ejected from the dispenser 40 through the nozzle 300. As illustrated, the piston head/piston stem assembly 276, 292 is held substantially fixed, and the main cylinder 262 is advanced in the direction of the nozzle 300 through the operation of the activator 60 between a first position (shown in FIG. 4) and a second position (shown in FIG. 7). It will be recognized that other arrangements could be provided, for example, where the main cylinder 262 is held fixed and the piston head/piston stem assembly 276, 292 is moved or where both the main cylinder 262 and the piston head/piston stem assembly 276, 292 are moved to provide relative motion.

As illustrated in FIGS. 4 and 7, the piston stem 292 has a flange 330 formed on an exterior surface 332 of the stem 292.

The support structure 186 has a pair of spaced walls 334, 336 formed therein that define a slot 338 therebetween. The flange 330 is received in the slot 338 to limit the motion of the stem 292 and associated head 276 relative to the cover 54, and thus the remainder of the dispenser 40.

Additionally, the second end 298 of the stem 292 is received in a nozzle fitting 350 that is attached to the frontal piece 184 and fits through a passage 352 formed in the frontal piece 184. The nozzle fitting 350 has a guide tube 354 with a first open end 356 and a second end 358 having a shoulder 360 that defines an opening 362. The base 304 of the nozzle 300 has a lip 364 that cooperates with the shoulder 360 with the nozzle 300 disposed through the opening 362. The second end 298 is then disposed within the guide tube 354 and abuts the base 304 of the nozzle 300, and the movement of the piston stem 292 is also limited in this fashion.

By contrast, an annular sleeve 370 is fitted about an exterior surface 372 of the main cylinder 262. The sleeve 370 abuts a shoulder 374 defined in part by the ring 312 of the sealing assembly. The sleeve 370 cooperates with the shoulder 374 to impart the motion of the sleeve 370 to the main cylinder 262.

The sleeve 370 also has lugs (not shown) that depend outwardly from the sleeve 370. These lugs are received in apertures (not shown) formed at the ends of arms 380 of a link 382 that is pivotally connected to the activator 60. The link 382 has a base 384 that may be received, for example, in holes (not shown) formed in the underside of the activator 60. As best seen by comparing FIGS. 4 and 7, the movement of the activator 60 downwardly, as indicated by the arrow "D" in FIG. 7, causes movement of the main cylinder 262 in the direction of the piston head/piston stem assembly 276, 292.

The relative motion and sizes of the cylinder 262 and piston heat/piston stem assembly 276, 292 may be adjusted by the manufacturer, for example, to control the dose of toothpaste dispensed by the dispenser 40. For example, the strength of the spring 282 may control, at least in part, the relative motion of the cylinder 262 and the piston heat/piston stem assembly 276, 292. For that matter, variations in the diameter of the cylinder 262 may influence how much toothpaste is dispensed, even if the relative motion between the cylinder 262 and the piston heat/piston stem assembly 276, 292 remains constant. It will be recognized that a variety of adjustments may be made to the various elements of the pumping system to vary the dose. However, according to at least certain embodiments, the various adjustments may be made so that the pumping system 70 dispenses a child's size dose (e.g., the dose may be between 0.25 and 0.33 grams of toothpaste).

Moreover, while the user may vary the dosage by, for example, not transitioning the activator 60 between the first and second positions, if the activator is fully transitioned between the position shown in FIG. 4 and that shown in FIG. 7, it is believed that a substantially equally sized dose, or unit dose, may be dispensed each time. It is further believed that by dispensing such a unit dose each time the activator 60 is depressed may make the dispenser 40 more useful for younger users, who may lack the ability to manipulate conventional dispensers to provide uniform results.

Figure 12:
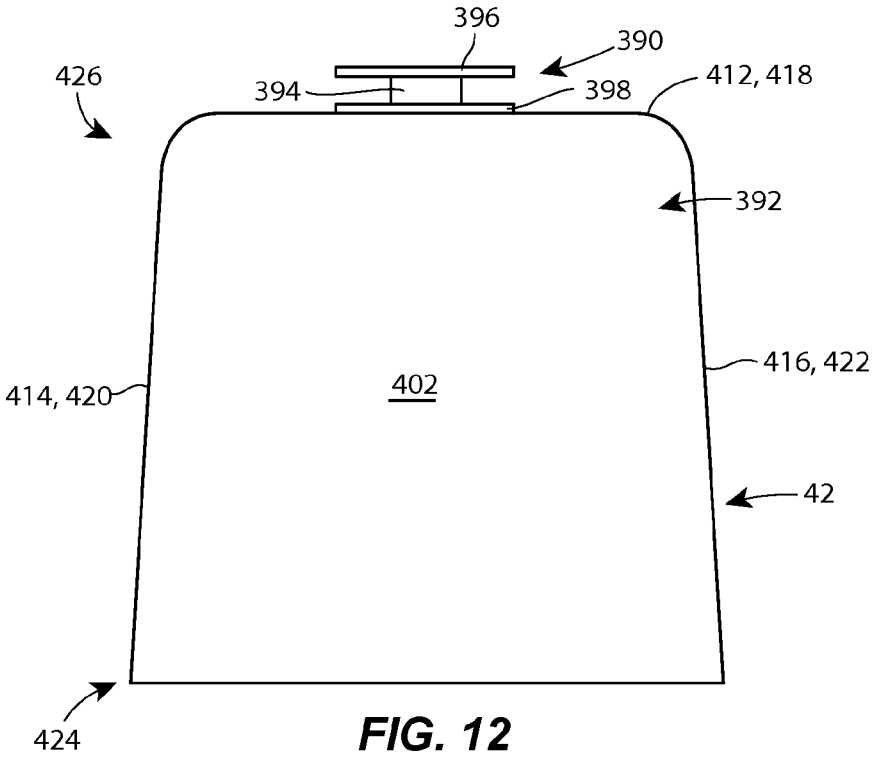
FIG. 12 is a side view of a toothpaste refill that may be used with the toothpaste dispenser of FIG. 1.
Figure 13:
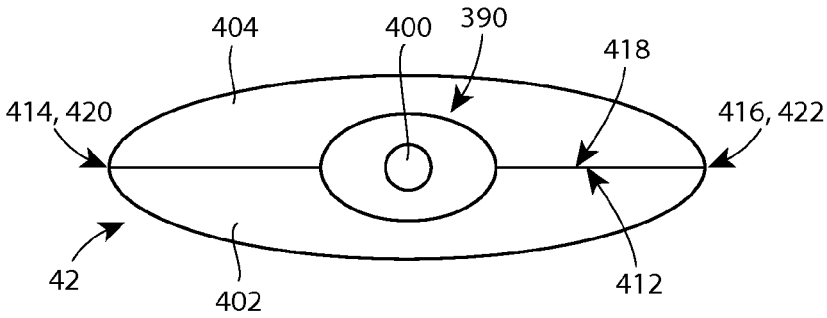
FIG. 13 is a plan view of the toothpaste refill of FIG. 12.
Figure 14:
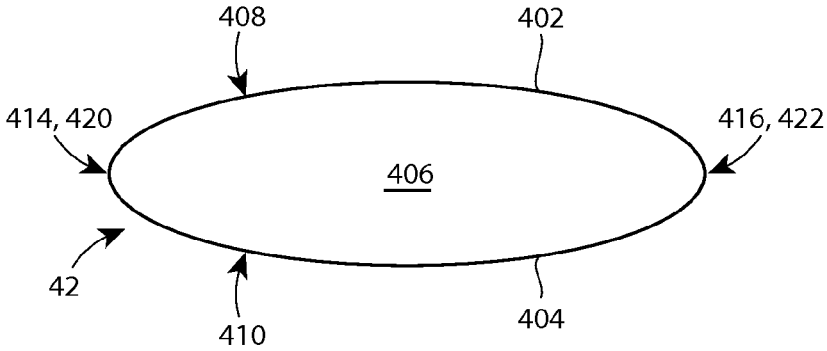
FIG. 14 is a bottom view of the toothpaste refill of FIG. 13.

Having thus described the toothpaste dispenser 40 in greater detail, the toothpaste refill 42 is now discussed, with reference to FIGS. 12 and 13. The refill 42 includes a guide 390 and a pouch 392.

The guide 390 has a central cylindrical stem 394 along which are spaced two flanges 396, 398. A passage 400 is disposed through the stem 394 and the flanges 396, 398. The flanges 396, 398 cooperate with the arms 130, 132 of the carrier 120 to limit the movement of the refill 42 relative to the carrier 120.

The pouch 392 includes a front wall panel 402, a rear wall panel 404, and a bottom wall panel 406, which may collectively be referred to as the wall of the pouch 392. The front wall panel 402 is attached along a lower edge 408 to the bottom wall panel 406, and the rear wall panel 404 is attached along a lower edge 410 to the bottom wall panel 406. The front wall panel 402 is attached along edges 412, 414, 416 to edges 418, 420, 422 of the rear wall panel 404. The edges 412, 418 of the front and rear wall panels 402, 404 are also sealed about a section of the stem 394 that extends past the flange 398. The pouch 392 is thus gusseted at one end 424, but not the other 426. It will be recognized that the relative or absolute dimensions of the pouch 392, or the refill 42 for that matter, are not limited to those as illustrated, and the size and shape of the refill 42 may vary.

Figure 15:
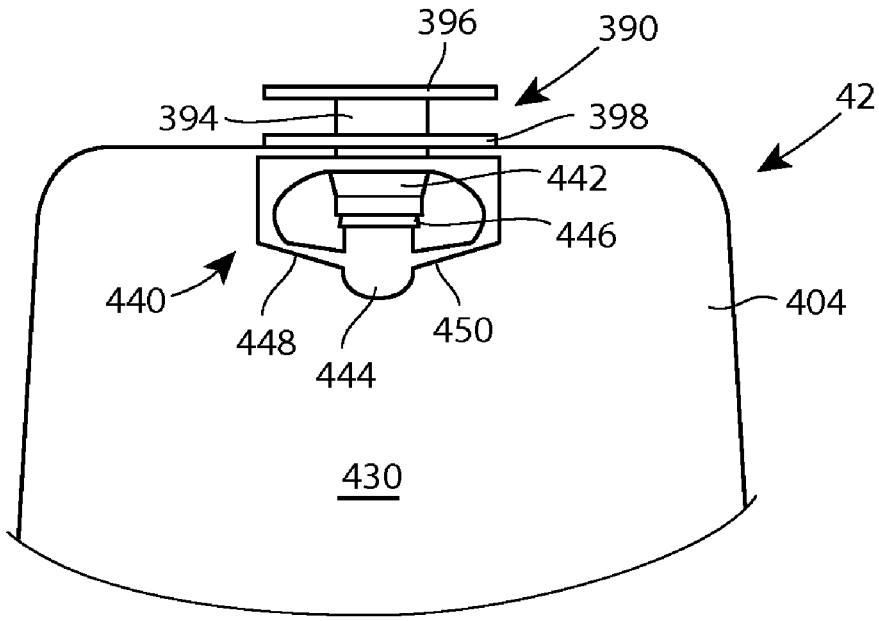
FIG. 15 is a fragmentary, side view of the refill of FIG. 12 having a guide and a pouch, with a wall of the pouch removed to expose a valve contained in the pouch in a first, closed state.
Figure 16:
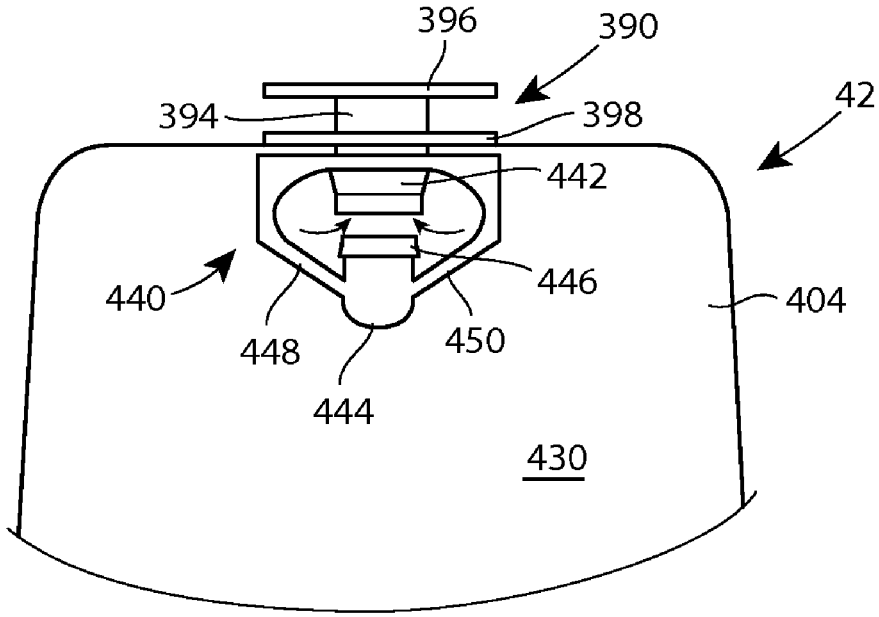
FIG. 16 is a fragmentary, side view of the refill of FIG. 12, with the valve in a second, open state.

The wall panels 402, 404, 406 define an internal space 430, as seen in FIGS. 15 and 16. Toothpaste may be disposed in the internal space 430. The toothpaste may be of any desirable formulation, and may have a pleasant taste to encourage its use. A valve or seal 440 may also be disposed in the internal space 430.

The valve 440 may be attached to or formed with the guide 390, as illustrated. The valve 440 may have a hollow fitting 442 with a passage therethrough that is in communication with the passage 400, as illustrated. The valve 440 may also have a plug 444 that cooperates with the hollow fitting 442 to occlude the passage in the fitting 442 to limit passage of the toothpaste out of the space 430. To this end, the plug 444 may have a tapered rim 446 that improves the likelihood of a snug fit between the fitting 442 and the plug 444. Moreover, the valve 440 may have arms 448, 450 that bias the plug 444 into cooperation with the fitting 442 (i.e., a closed state), as shown in FIG. 15. However, with the pointed end 162 disposed into the passage 400, the end 162 cooperates with the plug 444 to move the plug 444 out of engagement with the fitting 442 (i.e., an open state), as illustrated in FIG. 16. In this state, toothpaste from the refill 42 may flow into the apertures 164 in the inlet piece 150. According to certain embodiments, the plug 444 may return or be returned to the closed state when the pointed end 162 is removed from the passage 400, although, according to other embodiments, the plug 444 remains in the open state once the plug 444 moves from the closed state to the open state (i.e., the plug moves only once from the closed state to the open state).

Having thus described the dispenser 40 and the refill 42, the use of the dispenser 40 with the refill 42 is now discussed.

Initially, the refill 42 may be loaded into the dispenser 40. As a first step, the cover 54 is pivoted relative to the base 52, from the position shown in FIG. 4 to that shown in FIG. 5. With the cover 54 as shown in FIG. 5, the carrier 120 is advanced from the operative position (FIG. 5) to the loading position (FIG. 6). With the carrier 120 in the loading position, the refill 42 is disposed on the carrier 120 such that the flanges 396, 398 cooperate with the arms 130, 132 of the holder 134, thereby positioning the refill 42 on the carrier 120 in a desired orientation. With the refill 42 so disposed on the carrier 120, the carrier 120 is returned to the operative position. In doing so, the pointed end 162 of the inlet piece 150 moves the valve 440 from the closed position (FIG. 15) to the open position (FIG. 16), thereby placing the pumping system 70 in communication with the contents of the refill 42.

While a caregiver (such as a parent) may customarily load the refill 42 into the dispenser 40, it may be recognized that, in keeping with a kid-friendly theme, the dispenser 40 roughly approximates a head, for example a frog's head. In particular, the cover 54 and base 52 may represent the upper and lower portions of the mouth and the carrier 120 may represent the tongue. Thus, it may be understood that the refill 42 is "fed" into the dispenser 40 by opening the "mouth" (cover 54 and base 52), placing the refill 42 on the "tongue" (carrier 120), pushing the tongue back into the mouth, and closing the mouth.

With the refill 42 now coupled to the pumping system 70, the user is now ready to use the toothpaste dispensing system. As a first step, a toothbrush may be disposed by the user against the shoulder 196 formed in the frontal piece 184 of the dispenser 40, and in particular the cover 54. With the toothbrush so disposed, the bristles of the brush may be disposed below the nozzle 300. Depression of the activator 60 causes toothpaste to be ejected from the nozzle 300. Specifically, movement of the activator 60 causes movement of the main cylinder 262 relative to the piston head/piston stem 276, 292, which forces the toothpaste in the main pumping chamber 274 out of the nozzle 300 because the ball 286 prevents passage of the toothpaste backwards along the pumping system 70. As force is removed from the activator 60, the cylinder 262 is allowed to return to is rest position relative to the head/stem 276, 292. The nozzle 300 closes up after ejection of the toothpaste onto the toothbrush and the ball 286 forward, permitting toothpaste to be drawn out of the refill 42 and to fill the substantially empty chamber 274. It is believed that the closure of the slit 302 of the nozzle 300 may act to "cut" the toothpaste off, to limit messiness, and to limit the exposure of the toothpaste in the system 70. It is also believed that there may be a delay in the motion of the ball 286, as influenced by such factors as, for example, the spring strength and the viscosity of the toothpaste, which delay may have at least the beneficial effect of preventing rapid repeated dispensings, thereby preventing the contents of the refill 42 from being discharged too quickly by an overeager young user.

When the toothpaste in the refill 42 is completely or substantially dispensed, or when the user so desires (for example, to change the flavor of the toothpaste dispensed by the dispenser 40), the cover 54 is again moved relative to the base 52 to expose the carrier 120. The carrier 120 is moved from the operative position (FIG. 5) to the loading position (FIG. 6), the first (old) refill 42 removed, and the second (new) refill 42 disposed on the carrier 120. Where the internal valve 440 is resealable, if the refill 42 is not entirely empty, the exposure of the remainder of the contents in the refill 42 may be limited, thereby preserving, as least in part, the contents' freshness. The carrier 120 is then advanced to its operative position, the cover 54 is closed, and the dispenser is again ready for use.

All documents cited in the Detailed Description are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A toothpaste dispensing system, comprising:

a dispenser including:

a low-profile housing;

a pumping system disposed in the housing, the pumping system having an inlet and an outlet, the pumping system having a rest state and an active state, the pumping system ejecting toothpaste as it transitions from the rest state to the active state;

a low-force activator coupled to the pumping system to transition a pump from the rest state to the active state; and a carrier disposed within the housing, the carrier having a holder and moveable between a loading position, wherein the holder is spaced from the inlet of the pumping system, and an operative position, wherein the holder is adjacent the inlet of the pumping system; and a toothpaste refill disposed on the carrier and coupled to the inlet of the pumping system.

2. The toothpaste dispensing system according to claim 1, wherein:

the low-profile housing includes a base that is disposable on a surface, and a combination of the dispenser and the toothpaste refill has a center of mass and a center of volume, the center of mass being closer to the surface when the base is disposed on the surface than the center of volume.

3. The toothpaste dispensing system according to claim 2, wherein:

the toothpaste refill has a first state wherein the refill is full of the toothpaste and a second state wherein the refill is empty, and the center of mass of the combination of the dispenser and the toothpaste refill is closer to the surface when the base is disposed on the surface than the center of volume with the toothpaste refill in either the first state or the second state.

4. The toothpaste dispensing system according to claim 1, wherein the toothpaste refill includes a guide that mates with the holder.

5. The toothpaste dispensing system according to claim 4, wherein:

the holder includes arms, the guide includes spaced flanges, and the arms of the holder are received between the spaced flanges to limit movement of the refill relative to the carrier.

6. The toothpaste dispensing system according to claim 1, wherein:

the pumping system includes an inlet piece with a male profile; and the toothpaste refill has a passage with a valve in communication therewith, the male profile of the inlet port engaging the valve to move the valve from a closed position to an open position when the male profile is disposed within the passage of the refill.

7. The toothpaste dispensing system according to claim 6, wherein the valve remains in the open position after the male profile is withdrawn from the inlet port.

8. The toothpaste dispensing system according to claim 1, wherein:

the activator moves between a first position and a second position; and the pumping system provides a unit dose when the activator moves between the first position and the second position.

9. The toothpaste dispensing system according to claim 8, wherein the unit dose is a child's size dose.

10. A toothpaste refill for use with a toothpaste dispenser including a housing, a pumping system having an inlet, and a carrier having a holder; wherein the carrier is moveable between a loading position, wherein the holder is spaced from the inlet of the pumping system, and an operative position, wherein the holder is adjacent the inlet of the pumping system, the refill comprising:

a wall that defines a pouch;

a guide attached to the wall and having a passage therethrough, the guide being adapted to mate with the holder to limit movement of the refill relative to the carrier;

a valve disposed within the pouch and in communication with the passage in the guide; and a volume of toothpaste disposed in the pouch.

11. The toothpaste refill according to claim 10, wherein the holder includes a pair of arms and a connector has a pair of spaced flanges, each of the flanges cooperating with one of opposite sides of the arms when the guide is disposed on the holder.

12. The toothpaste refill according to claim 10, wherein the valve has a first, closed state and a second, open state, the valve capable of transition once from the closed state to the open state.

* * * * *

UNITED STATES PATENT AND TRADEMARK OFFICE

CERTIFICATE OF CORRECTION

PATENT NO. : 7,651,012 B2
APPLICATION NO. : 11/240284
DATED : January 26, 2010
INVENTOR(S) : Colman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1153 days.

Signed and Sealed this

Twenty-third Day of November, 2010

David J. Kappos

David J. Kappos
*Director of the United States Patent and Trademark Office*